US006755966B1

(12) United States Patent
Reed

(10) Patent No.: US 6,755,966 B1
(45) Date of Patent: Jun. 29, 2004

(54) WASTE ASSEMBLY ALLOWING ADJUSTABLE FITMENT OF A FLOOR WASTE OR APPLIANCE

(76) Inventor: Selwyn Reed, P.O. Box 489, Mona Vale, New South Wales (AU), 1660

( * ) Notice: Subject to any disclaimer, the term of this patent is extended or adjusted under 35 U.S.C. 154(b) by 0 days.

(21) Appl. No.: 09/601,375

(22) PCT Filed: Jan. 28, 1999

(86) PCT No.: PCT/AU99/00058

§ 371 (c)(1),
(2), (4) Date: Sep. 21, 2000

(87) PCT Pub. No.: WO99/39057

PCT Pub. Date: Aug. 5, 1999

(30) Foreign Application Priority Data

Jan. 28, 1998 (AU) ..... PP1507

(51) Int. Cl.[7] ..... E03F 5/04
(52) U.S. Cl. ..... 210/164; 210/165; 4/679
(58) Field of Search ..... 210/163, 164, 210/165, 166, 170; 4/679, 293

(56) References Cited

U.S. PATENT DOCUMENTS

| | | | | |
|---|---|---|---|---|
| 663,978 A | * | 12/1900 | O'Brien | 210/164 |
| 1,646,994 A | * | 10/1927 | Douher | 210/163 |
| 3,040,895 A | * | 6/1962 | Sisk | 210/166 |
| 4,345,998 A | * | 8/1982 | Graffis et al. | 210/164 |
| 5,124,031 A | * | 6/1992 | Dallmer | 210/164 |
| 5,378,356 A | * | 1/1995 | Logsdon | 210/166 |
| 6,269,495 B1 | * | 8/2001 | Sondrup | 210/163 |

FOREIGN PATENT DOCUMENTS

| | | | |
|---|---|---|---|
| AU | 710604 | * | 4/1998 |
| DE | 2109094 | * | 9/1972 |
| EP | 862 | * | 3/1979 |
| GB | 16588/93 | * | of 1893 |
| GB | 22269/01 | * | of 1901 |
| GB | 22403/02 | * | of 1902 |
| GB | 13586/03 | * | of 1903 |
| GB | 1208833 | * | 10/1970 |
| WO | 80/01701 | * | 8/1980 |
| WO | 95/13434 | * | 5/1995 |

* cited by examiner

*Primary Examiner*—Christopher Upton

(57) ABSTRACT

A floor or ground surface waste assembly for receiving floor or appliance generated waste including a waste body (1) defining a waste collecting receptacle (2). The waste body (1) includes an open mouth (3) for receiving waste products from a floor grate or appliance, an outlet connected to said reservoir in communication with said mouth for connecting the waste assembly to a waste drainage line for eventual discharge of said waste, said waste body (1) also including a bearing surface (9) extending at least partially about the periphery of said waste body (1) and which is capable of supporting directly or indirectly a grate or appliance outlet; wherein said mouth (3) is proportioned to allow selective positioning of a grate or appliance outlet within said mouth within the limits of the periphery of the waste body such that said selective positioning of said grate or appliance outlet obviates the necessity for said appliance outlet or grate to align axially with or be directly connected to underfloor drainage plumbing.

12 Claims, 6 Drawing Sheets

WASTE ASSEMBLY ALLOWING ADJUSTABLE FITMENT OF A FLOOR WASTE OR APPLIANCE

The present invention relates to drainage apparatuses and more particularly to a waste assembly for use with waste generating appliances and as a surface drain including a reservoir which accommodates a floor waste or waste discharge line from an appliance in a selected location within the periphery of the reservoir.

PRIOR ART

There are in existence a wide variety of surface drains and floor wastes and waste outlets associated with appliances which link directly or indirectly with plumbing infrastructure in a building. These are found in public and private installations alike and are usually positioned at a low point in the drainage network. Generally in the case of floor drains and wastes these include a grate which finishes the assembly and allows ingress of surface waste water.

One such floor waste is disclosed in German specification D E 4115638. This document discloses a metal drain gutter inserted in a concrete or plaster floor and includes a grill which covers the opening but allows the waste water to enter the gutter. The floor waste includes a well or receptacle defined by a profiled structure including shoulder regions which receive the grate.

Usually, floor wastes are positioned to align with under floor plumbing so there is a significant predetermined restriction on the scope of available movement of above floor fittings to accommodate the position of plumbing and floor cladding such as floor tiling. As floor wastes and appliances must traditionally be fitted in with floor cladding this usually requires an adjustment of the grate or appliance outlet particularly where tiles and the like are used (as is common in wet areas) to suit the floor cladding. Adjustment of the waste or appliance outlet to match drainage plumbing infrastructure has in the past been inhibited once underfloor drainage plumbing is in place as there is almost no flexibility in positioning of above floor waste generating appliances or floor wastes. According to prior art methods an installer has two main options for symmetric installation of floor tiles particularly with the inherent restriction of non adjustability of floor grates. The first alternative involves setting the tiles to room dimensions in which case desired alignment with the grate may be a matter of lack or may not occur. The second involves setting the tiles to suit the position of the grate in which case the fit to the room layout is sacrificed.

According to the prior art the final position of a floor waste is dictated by the underfloor plumbing infrastructure, but the floor cladding must then be adjusted to suit the waste position which can often result in less than aesthetically pleasing results. In conventional drains the inlet orifice (or grate) is substantially in alignment with the drainage pipe and it is this requirement which dictates the final position of the grate.

Another prior art surface drain is disclosed in U.S. Pat. No. 2,182,795. This patent teaches a waste having a wide mouthed waste water receiving receptacle described as a drain body which accommodates a removable grate on a continuous recessed retaining step in the drain body. The drain body is sized to also receive a removable strainer bucket which catches debris and enabling periodic cleaning of the drain as well as preventing debris entering the drain system. As with most known floor waste arrangements, the positioning of this waste and more particularly the grate is dictated by the set position of the plumbing infrastructure underneath.

U.K. patent specification 1208 833 discloses a fluid waste gulley including a hopper which collects drainage water via top members which might be a grate or plate with an inlet orifice which seat on a ledge on the hopper. The grate or inlet plate disclosed in that patent have their floor positions dictated by the configuration and position of the hopper. However the arrangement described in this patent is directed primarily to the provision of a gulley adaptable to various layouts in rainwater and surface water systems. The top members of the gully assembly are not intended as flooring and the assembly itself is primary intended for stormwater and surface water. The arrangement described in that patent allows interchangability of two top members but is not intended as a waterproofing solution. Nor does it teach versatility of fitment at the distal end of a downpipe. In fact the disclosure teaches away from the present invention. For instance, the disclosure teaches interchangeable members creating alternative layouts.

Furthermore, the arrangement described in the UK patent is directed to an objective entirely different from that of the present invention in an its forms.

Thus, in the prior art floor waste arrangements there is almost no flexibility as to the location of the grate once the underfloor plumbing infrastructure is set and this is usually completed first.

This absence of flexibility means that a waste or appliance can only be located where it will align with an inlet to the main drainage plumbing and that subsequent work such as floor tiling must accommodate the waste or appliance outlet in that the tiling patterning is in most cases interrupted such that the result is aesthetically unacceptable.

INVENTION

The present invention seeks to overcome the aforesaid difficulties inherent in the prior art by providing an assembly for receiving a floor grate or waste generating appliance outlet allowing selective positioning of a grate associated with the assembly such that whilst the plumbing infrastructure may be preset the installer of the assembly has significant flexability in the positioning of the grate or outlet of an appliance within the limits of the mouth of the assembly.

This allows floor cladding such as tiles to be located according to a selected pattern and not dictated by the positioning of the grate. Thus the grate can be positioned selectively to accommodate tile joins by avoiding them altogether or intersecting with them. This also allows selective positioning of a waste generating appliance or floor grate without requiring alignment between said grate or appliance outlet and an inlet to drainage plumbing infrastructure.

The present invention also seeks to provide an alternative grate assembly suitable for use with the above waste assembly.

According to another aspect, the present invention provides a waste body for use with an assembly for receiving a floor grate or waste generating appliance outlet which connects with an inlet to drainage plumbing in a building; thereby obviating the necessity for the floor grate or outlet of said appliance to align with said inlet.

In one broad form the present invention comprises a floor or ground surface waste assembly including; a waste body having a waste collecting receptacle; the receptacle including an open mouth for receiving waste products from a floor grate or appliance; an outlet in communication with said mouth for connecting the waste assembly to an inlet of a waste drainage line for eventual discharge of said waste, said waste body also including a bearing surface extending at least partially about the periphery of said waste body and which supports directly or indirectly a grate or appliance outlet; such that the grate or appliance outlet may be positioned at any location within the periphery of the waste body thereby allowing the grate or appliance outlet to be selectively located to accommodate a predetermined pattern, layout or configuration of floor or ground cladding.

According to a preferred embodiment the waste assembly further comprises an insert which locates on said bearing surface of said waste body and receives said grate or appliance outlet in a preselected location in or on the insert.

The insert which is removeable prior to installation is fixed permanently once the waste assembly is fully installed as an element of flooring.

The position may be selected according to the positioning of the floor cladding such as tiles and the like to achieve the most aesthetically pleasing appearance. Additional the mouth of the waste body allows latitude for selective positioning of an appliance outlet. According to a preferred embodiment the insert functions as part of a flooring structure. In its broadest form the present invention comprises; a waste assembly for receiving and discharging waste from a floor grate or waste generating appliance and including a waste body having an inlet mouth which receives an insert and we is in communication with an outlet on said waste body for discharging said waste; wherein said inlet mouth is proportioned to allow selective positioning of a grate or appliance outlet within said insert within the limits of the periphery of the waste body such that said selective positioning of said grate or appliance outlet obviates the necessitity for said appliance outlet or grate to align with or be directly connected to said outlet or an inlet of underfloor drainage plumbing.

These arrangements have the added advantage of preventing unwanted interruption to a predetermined floor cladding pattern, layout or configuration. Preferably the grate or appliance outlet may be selectively positioned to avoid or alternatively intersect with a join or joins in said floor cladding.

In another form the present invention comprises; a waste body for use with an assembly for colon and discharge of waste from a waste generating appliance or floor waste, the waste body comprising an open mouth reservoir for receiving said waste and including an outlet for discharging said waste received in said reservoir, the waste body further including a bearing surface which receives an insert proportioned to cover said mouth, the insert adapted to receive a grate or outlet of a waste generating appliance positioned in the insert such that the outlet of the waste body connects to and aligns with an inlet to underfloor drainage plumbing; wherein the dimension of said mouth is such that said grate or appliance outlet need not align with said inlet to said underfloor plumbing thereby allowing flexibility in the positioning of said floor grate or appliance within the limits of a periphery of said waste body.

Preferably, the insert is set in the waste body with clearance for seepage via said shoulder In another form the present invention comprises: a waste assembly for receiving and discharging waste from a waste producing appliance, surface drain or the like in communication with the assembly; the assembly including; a waste body having an open mouth defining a recess for receiving said waste, and an outlet capable of connection to an inlet of drainage plumbing infrastructure allowing discharge of said waste; a closure member supported by the waste body for closing said mouth and which receives said surface drain or an outlet of said waste producing appliance; wherein the closure is proportioned such that an installer of said surface drain or outlet of said appliance may position said drain or appliance outlet at any selected position bounded by the periphery of said waste body thereby obviating the need for direct connection and/or axial alignment between said surface drain or appliance outlet and said plumbing infrastructure.

In another broad form the present invention comprises: a waste assembly for connecting an appliance outlet or floor drain to plumbing infrastructure of a building; the waste assembly comprising; a waste body having a wide mouth and defining a reservoir which includes an outlet which connects said waste body to said plumbing infrastructure, a shoulder region over said waste body for receiving a closure member closing said mouth and which receives via an opening formed therein an appliance outlet or floor drain; wherein said closure member is of sufficient area to allow a selection of the position of said appliance outlet or drain anywhere with the area defined by the periphery of the waste body such that the position in the closure of the appliance outlet or floor drain is not dictated by direct axial alignment of said appliance outlet or floor drain with said plumbing infrastructure.

Preferably, the closure member sits proud of said shoulder on projections thereon and forms part of floor structure.

In another form the present invention comprises: a grate assembly comprising: a retaining body which engages and is supported by flooring into which the grate assembly is inserted: a releasable cover retained in said retaining body and which allows waste to flow along and about a surface of said cover; a perforated strainer plate which allows passage of waste; an overflow tower which receives said waste in the event of blockage of said perforated strainer plate; wherein removal of said releasable cover allows access to said strainer for cleaning purposes.

According to one embodiment, the grate assembly is clamped with a lock nut to a prefabricated shower tray. In another embodiment the assembly is set in an adhesive or cementitous material. A thread on an outer surface of the retaining body facilitates anchorage of the assembly. Preferably, the closure comprises a roof including a contoured surface conducive to drainage and leg members supporting said roof and which engage a recess in said retaining body. Preferably, said legs bear on an upper surface of said strainer plate and are releasable from said recess in said retaining body by rotation.

Preferably removal of said cover allows access to said upper surface of said strainer plate for cleaning purposes.

Preferably, said overflow tower comprise a cylindrical body of predetermined height which terminates short of an underside of said cover. Said overflow tower operates in the event that debris blocks perforations on said strainer plate.

DETAILED DESCRIPTION OF EMBODIMENTS OF THE INVENTION

The present invention will now be described in more detail according to a preferred but non limiting embodiment and with reference to the accompanying drawings wherein.

Figure 1:
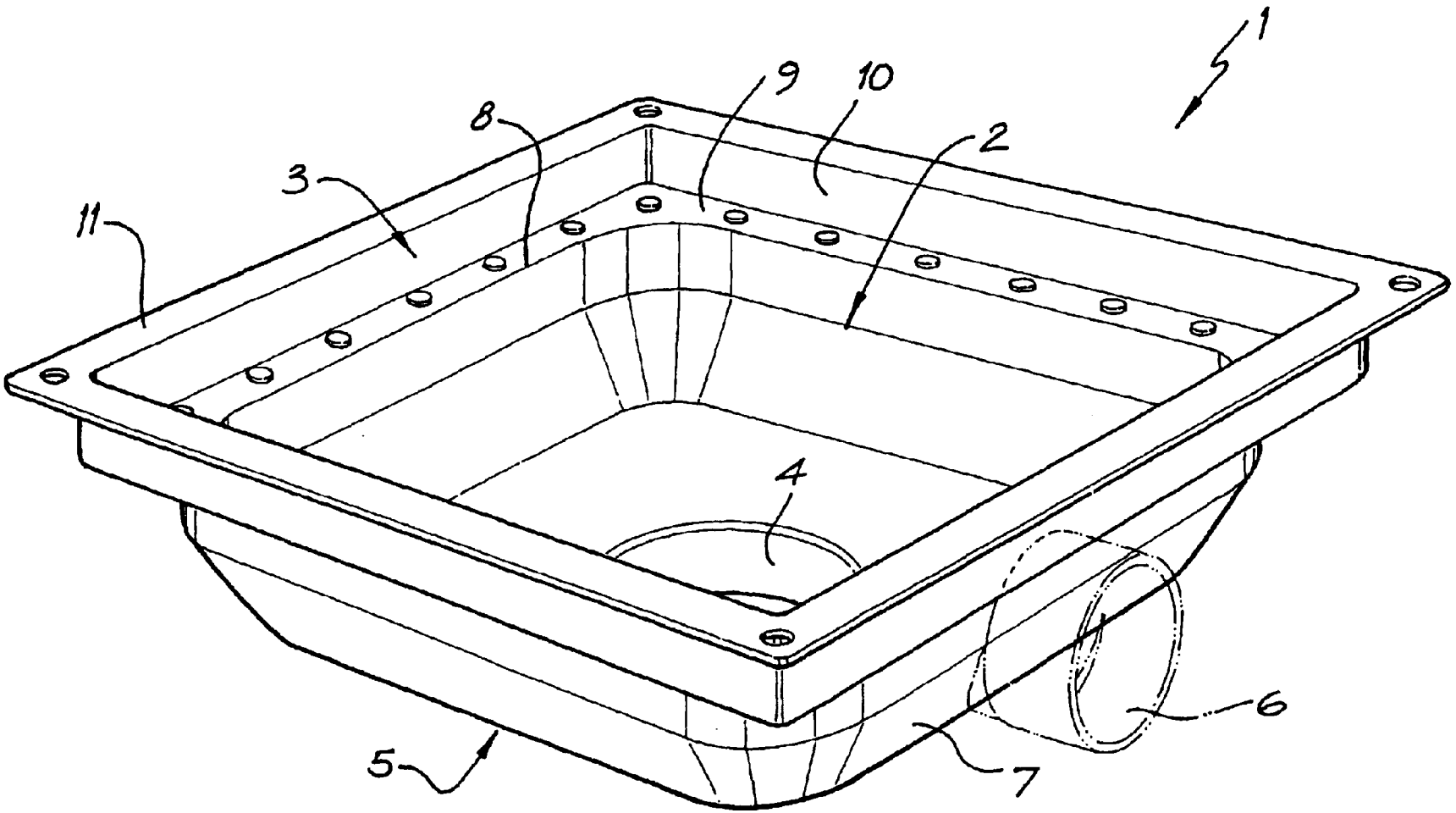
FIG. 1 shows a perspective view of a preferred embodiment of a waste body for use in the waste assembly according to the invention.

Referring to FIG. 1 there is shown a perspective view of a waste body 1 for use with a waste assembly (to be described with reference to FIG. 2) according to a preferred embodiment of the invention. Body 1 comprises a receptacle 2 having an open mouth 3 which receives waste water from an outlet of an appliance or floor grate. The receptacle further comprises an outlet or outlets which engages drainage plumbing (not shown) of a building to discharge waste received in receptacle 2.

Waste body 1 according to one embodiment includes an outlet 4 in base 5 or alternatively, an outlet 6 in wall 7 of base 5. The location of the outlet in waste body 1 will be chosen according to the location and attitude of the drainage plumbing inlet to which the waste body will be attached. Body 1 further comprises a shoulder 8 including a bearing surface 9 bounded by peripheral wall 10 terminating in peripheral flange 11. Waste body 1 may be any one of a variety of shapes such as but not limited to circular, triangular or rectangular according to design requests. Also waste body 1 may be set into concrete or a sand bed.

Figure 2:
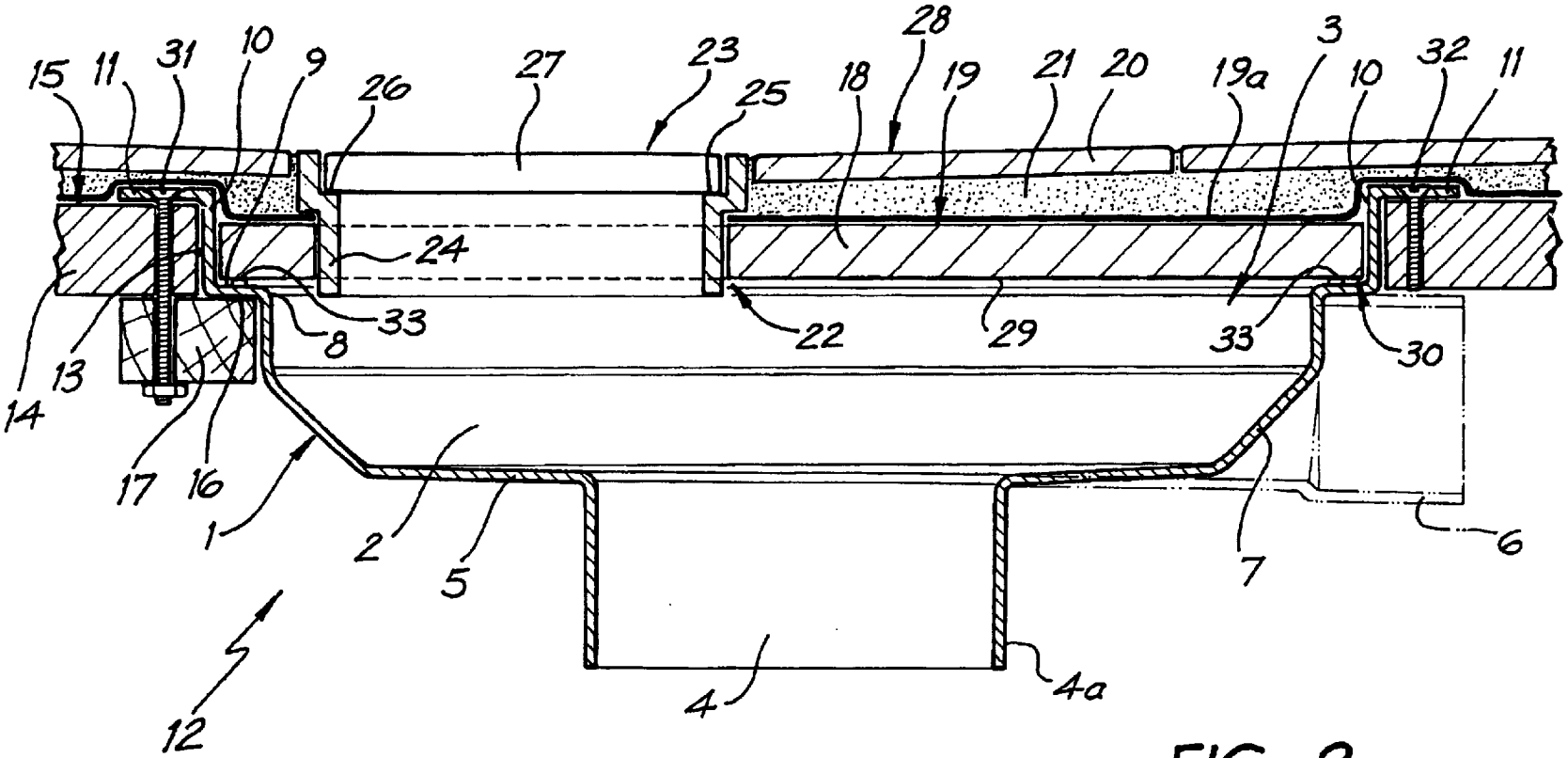
FIG. 2 shows a sectional view through a floor mounted waste assembly according to a preferred embodiment of the invention.

Referring to FIG. 2 there is shown a cross sectional view of a waste assembly 12 according to a preferred embodiment incorporating the waste body 1 of FIG. 1. Waste body 1 is shown located in an opening 13 in floor stratum 14 and engages floor surface 15 via peripheral flange 11. Underside surface 16 of shoulder 8 bears on surface 16 of support member 17 providing increased stability. Waste body 1 receives via bearing surface 9 insert 18 which spans the gap defined by peripheral wall 10 closing mouth opening 3 to waste body 1 but with clearance for seepage between said insert 18 and shoulder 8. Insert 18 acts as part of flooring and provides a bearing surface 19 for cladding which may typically comprise floor tiles 20 laid over an adhesive, waterproof membrane or cement render 21. Due to the area of insert 18 an installer of a grate or appliance outlet has flexibility as to the location insert 18 of the grate or outlet which might ideally be positioned in an opening 22 to either intersect with or avoid joins in tiles 20. Waste assembly 12 of FIG. 2 further comprises according to one embodiment grate assembly 23 which locates in opening 22 of floor insert 18.

Grate assembly 23 includes grate body 24 preferably defining a cylindrical wall and includes shoulder 25 having a bearing surface 26 which releasably receives and supports insert 27. Insert 27 includes perforations (not shown) which a low passage of fluid waste from surface 28 into reservoir 2.

The location in a floor stratum of waste body 1 will be dictated by drainage plumbing which places a natural limitation on its position in a floor structure. Where plumbing infrastructure including a drainage line is installed after a location is selected for the waste body this allows increased latitude for the selection of the waste body's location. This latitude is however diminished where plumbing infrastructure is installed first such as in concrete slab construction. In the case of prior art waste assemblies this effective pre determination of position prevents any possibility of fine adjustments to a floor waste or appliance outlet during installation as these must align accurately with a waste drainage inlet. This restriction will also inhibit the ability to position PC items such as a toilet pan, bidet, bath or premoulded shower tray to optimise finish.

Previously, it was essentially a matter of luck where a floor waste was positioned relative to floor cladding material such as tiles to achieve optimum finish. The random position of a floor waste could, should the position be undesirable, lead to increased work for a plumber and/or tiler and a poor finish. For instance, should the grate find itself at a conjunction of tiles up to four tiles may require cutting by the tile layer which could lead to an unsightly finish.

Alternatively, it may be desirable to locate a grate or appliance outlet at a conjunction so each tile adjacent to the floor grate is cut symmetrically relative to the grate.

In an alternative arrangement, the grate position can be selected to fall within the periphery of a tile. Similarly, with other forms of wet area cladding the grate position can be preselected anywhere within the limits of the peripheral walls of the waste body. Thus, the larger the mouth of the waste body the greater the flexibility of movement. One added advantage of the broad mouth waste body 1 is the larger capture area for fluid seepage percolating through the floor cladding or its supporting layer in the region of the grate assembly 23 near or within the peripheral wall 10 of waste body 1.

This overcomes what is a common problem in prior art waste plumbing installations, that is, leakage about the grate body such that fluid surface waste escapes capture by the drainage pipes eventually leading to rotting of the surrounding materials. Insert 18 is preferably a wet floor material such as compressed fibro with the ability to sustain load and maintain its structural integrity even under cyclic wetting and drying. Preferably, as shown in FIG. 2, upper surface 19 of insert 18 is lower than upper surface 15 of floor stratum 14 facilitating drainage of any seepage fluid. To ensure that seepage fluid has easy passage into receptacle 2 of waste body 1 bearing surface 9 preferably comprises projections 28 which create a gap between underside surface 29 of insert 18 and surface 9 of shoulder 8. Surface 29 of insert 18 engages projections 28 causing insert 18 to sit proud of and thus slightly spaced apart from surface 9 allowing passage through gap 22 of fluid waste eventually captured by receptacle 2. Preferably, the assembly further comprises a reinforced waterproof membrane 19*a* extending over and beyond insert 18 and peripheral flange 11 onto upper surface of floor 15. To ensure secure and immovable fitting of waste body 1 to flooring stratum 14 fasteners such as fastening screws 31 and 32 anchor peripheral flange 11 against floor stratum 14. The number of listening screws will generally be dictated by an installer but as a minimum it would be expected that there would be at least one screw per side of the waste body or where a shape other than square or rectangular is adopted such as circular or elliptical one fastener every 150 mm in most installations would suffice. Alternatively, to avoid cracking of plastic due to fastener restraint, fasteners need not penetrate flange 11. Once waste body 1 is in position the final connection may be made to an inlet of a drainage line (not shown) which will engage one or both of outlet pipes 4 or 6 spigot 4*a* may be fitted to outlet 4 of waste body 2 enabling a support flange to be glued on stabilsing waste body 2 and locking it into concrete where used with provision for a collar allowing height adjustment. Following that operation is the installation of insert 18. Then a selection is made for the position in insert 18 of grate assembly 23 comprising wall 24 which terminates in an upper shoulder 25 extending peripherally about said wall to receive grate insert 27 according to conventional methods of assembly.

Figure 3:
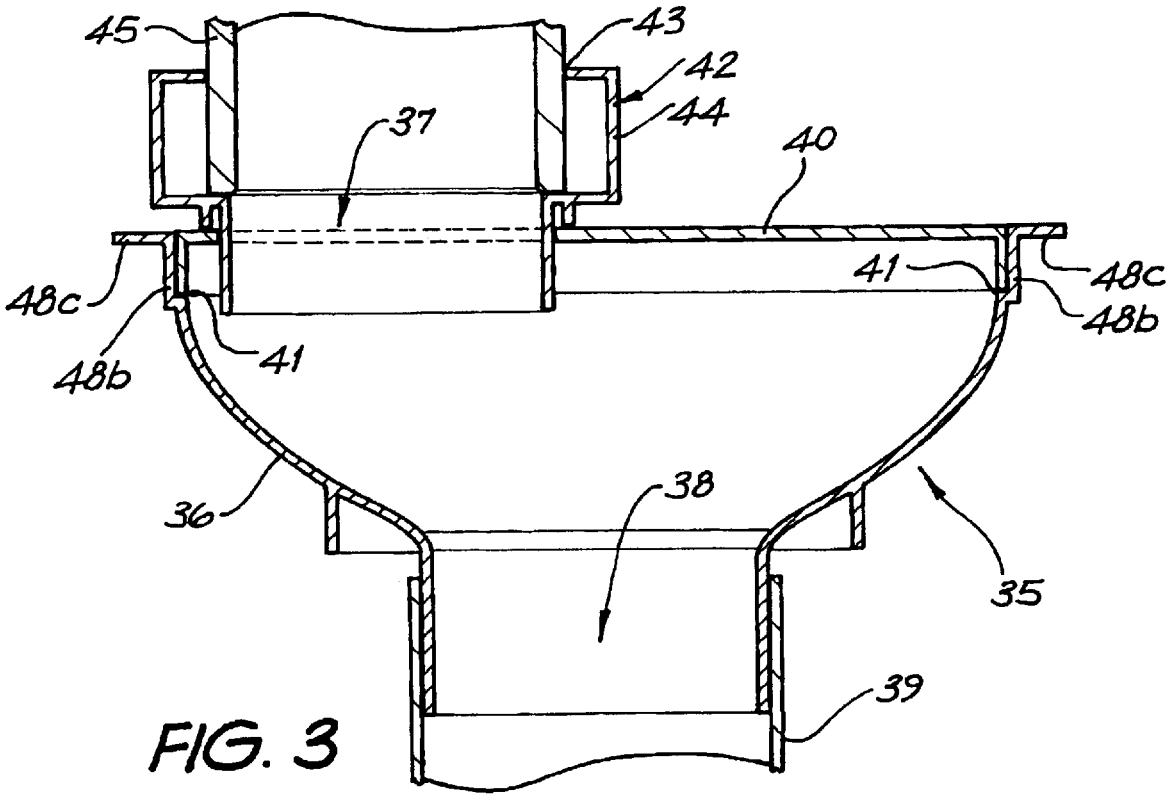
FIG. 3 shows a cross sectional elevation of an alternative waste body preferably for use where a waste generating appliance is connected to a waste assembly.

Waste body 1 is preferably constructed of a plastics material such as PVC or ABS generated in a mold but may also be formed from a metallic or other suitable material Referring to FIG. 3 there is shown a cross sectional elevation of a waste body 35 according to an alterative embodiment.

As previously described, the waste assembly of the present invention may be used with a floor waste assembly or a waste producing appliance which typically might be a toilet pan. Traditionally, the installation of a toilet pan necessitated accurate positioning so that pan outlet will be in alignment with an inlet to a drainage network which usually preceeds the installation of the appliance. Waste body 35 due to its unique configuration allows an installer of an appliance flexibility with respect to positioning of the waste outlet. More particularly, the appliance outlet need not be in perfect alignment with an inlet to drainage infrastructure. This overcomes fitting problems which can arise in tight spaces or where an appliance is required to accommodate floor cladding for an optimum aesthetic result. The waste also eliminates the problem of force fitting or fudging to ensure an appliance outlet aligns with a drainage line inlet.

According to the embodiment of FIG. 3 waste body 35 includes reservoir 36 which receives waste via an opening 37 in closure 40. Alternatively, closure 40 may be moulded or cast in plastic or metal and may be glued into a shoulder at the periphery of the waste body.

Closure 40 may be formed in the shape of a cap with a peripheral flange. This closure may be used for appliance discharge from such items as a toilet pan, bath or premade storage tray into which the pan collar, shower or bath waste outlet is attached such that the system is closed preventing odours or back wash. In an alternative embodiment, waste body 35 may be more steeply sloped (bowl shaped) to allow for easier passage of heavier waste such as from a toilet pan. This will result in waste body 35 having an annular wall 48*b* terminating in an annular flange 48*c*.

The closure 40 may be used where there will be no applied floor loads such as at the rear of a toilet pan or under a bath or prefabricated shower. The cap may also be glued in upside down and filled with concrete or other filler in the event the waste body is subject to floor loads.

Reservoir 36 terminates in outlet 38 which will be connected to an inlet 39 to underfloor drainage plumbing. Closure 40 which is preferably a glue—on moulded plastics lid engages peripheral shoulder 41 and seals reservoir 36. Closure 40 receives adaptor 42 which facilitates connection of a toilet pan outlet 45 to waste body 35 via opening 43 bounded by collar 44.

Figure 4:
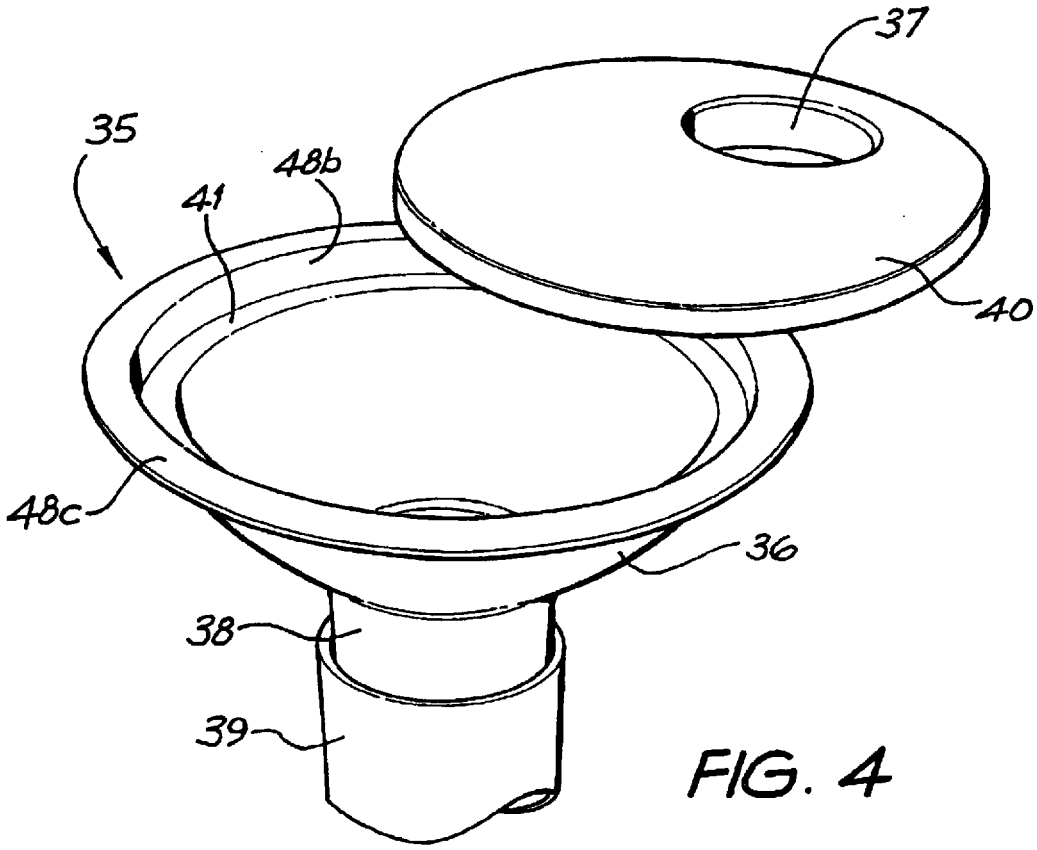
FIG. 4 shows a perspective view of the waste body of FIG. 3

Closure 40 may be fabricated from plastics such as PVC plastics or other suitable material. Referring to FIG. 4 there is shown a perspective view of the arrangement of FIG. 3 with corresponding numbering.

Figure 5:
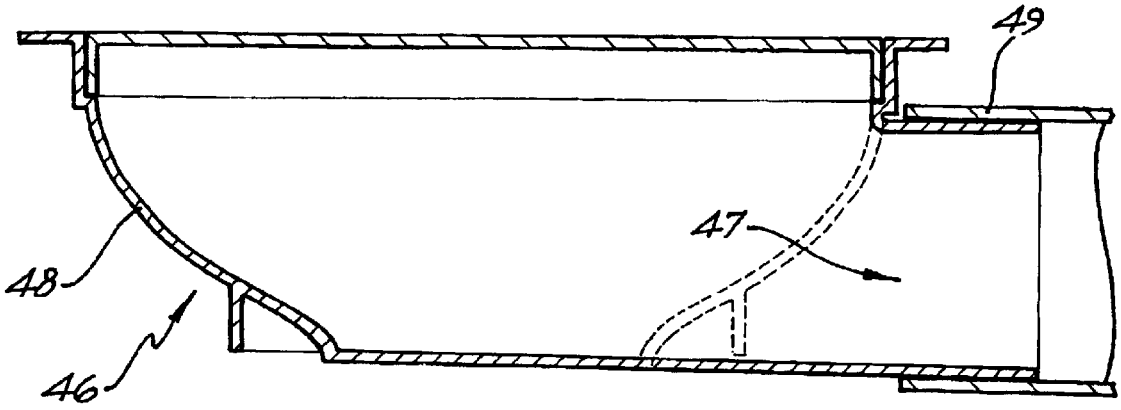
FIG. 5 shows a cross sectional elevation of a waste body of a type similar to that in FIG. 3 this time with a side outlet.
Figure 6:
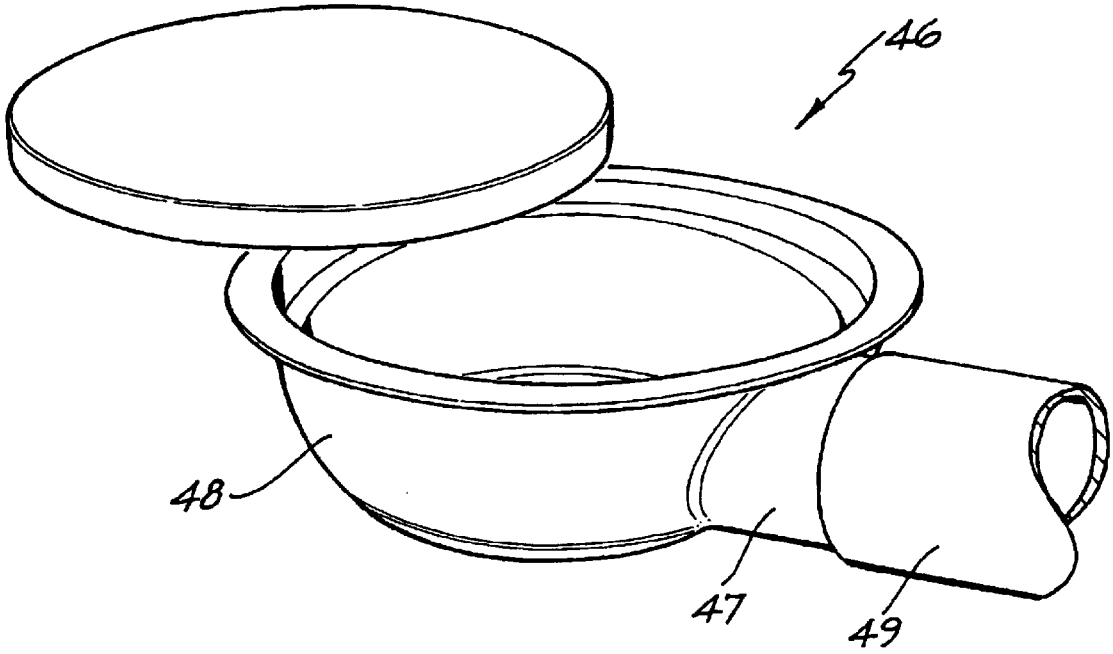
FIG. 6 shows a perspective view of the waste body of FIG. 5 according to a preferred embodiment.

FIG. 5 shows an alternative waste assembly 46 this time with side outlet 47 attached to waste body 48. Outlet 47 engages a side inlet 49 which eventually leads to waste drainage plumbing. Waste assembly 46 otherwise operates in a similar manner to that described for waste body 35. FIG. 6 shows a perspective view of the waste body of FIG. 5 with corresponding numbering.

Figure 7:
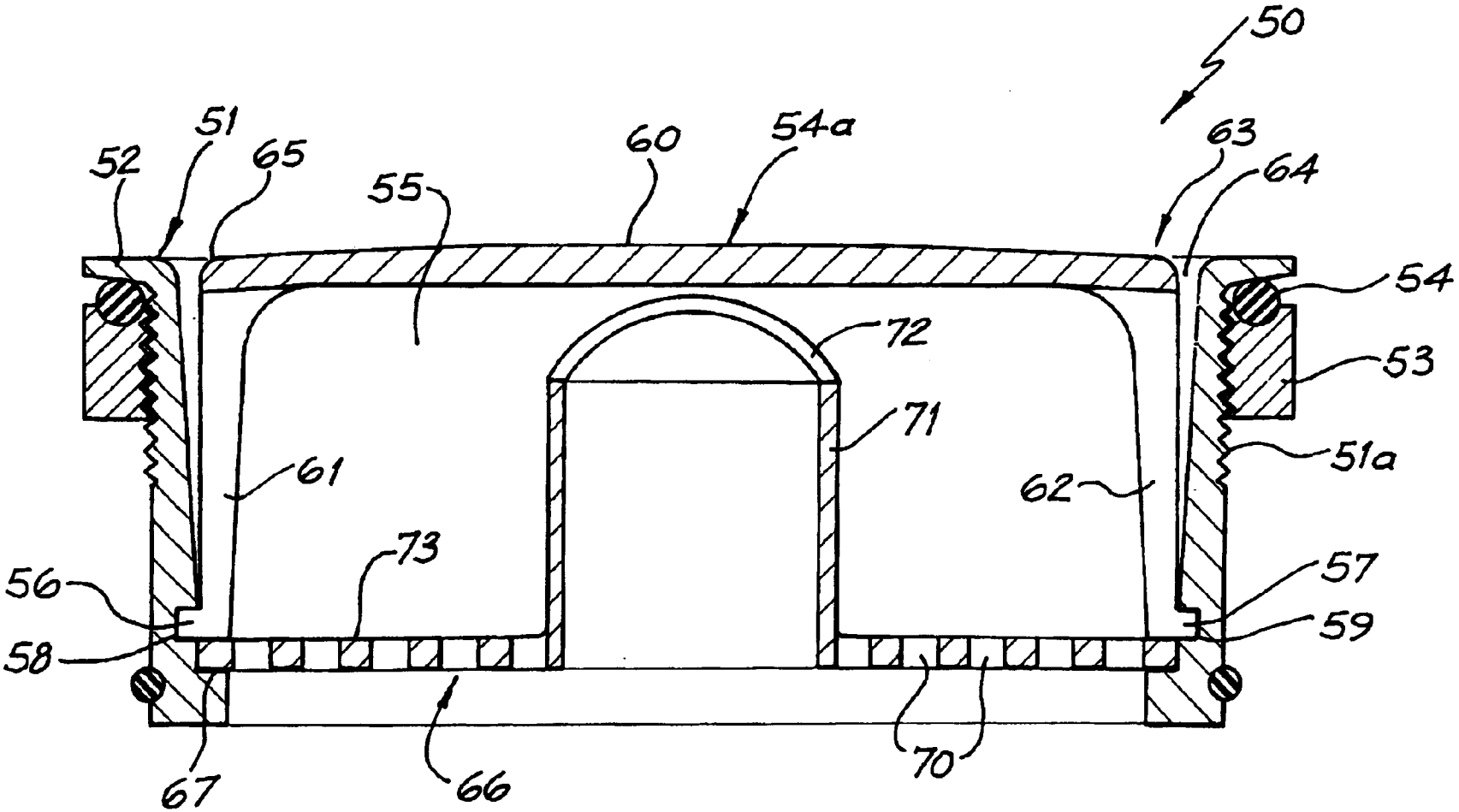
FIG. 7 shows a cross sectional elevation of a grate assembly according to a preferred embodiment.
Figure 8:
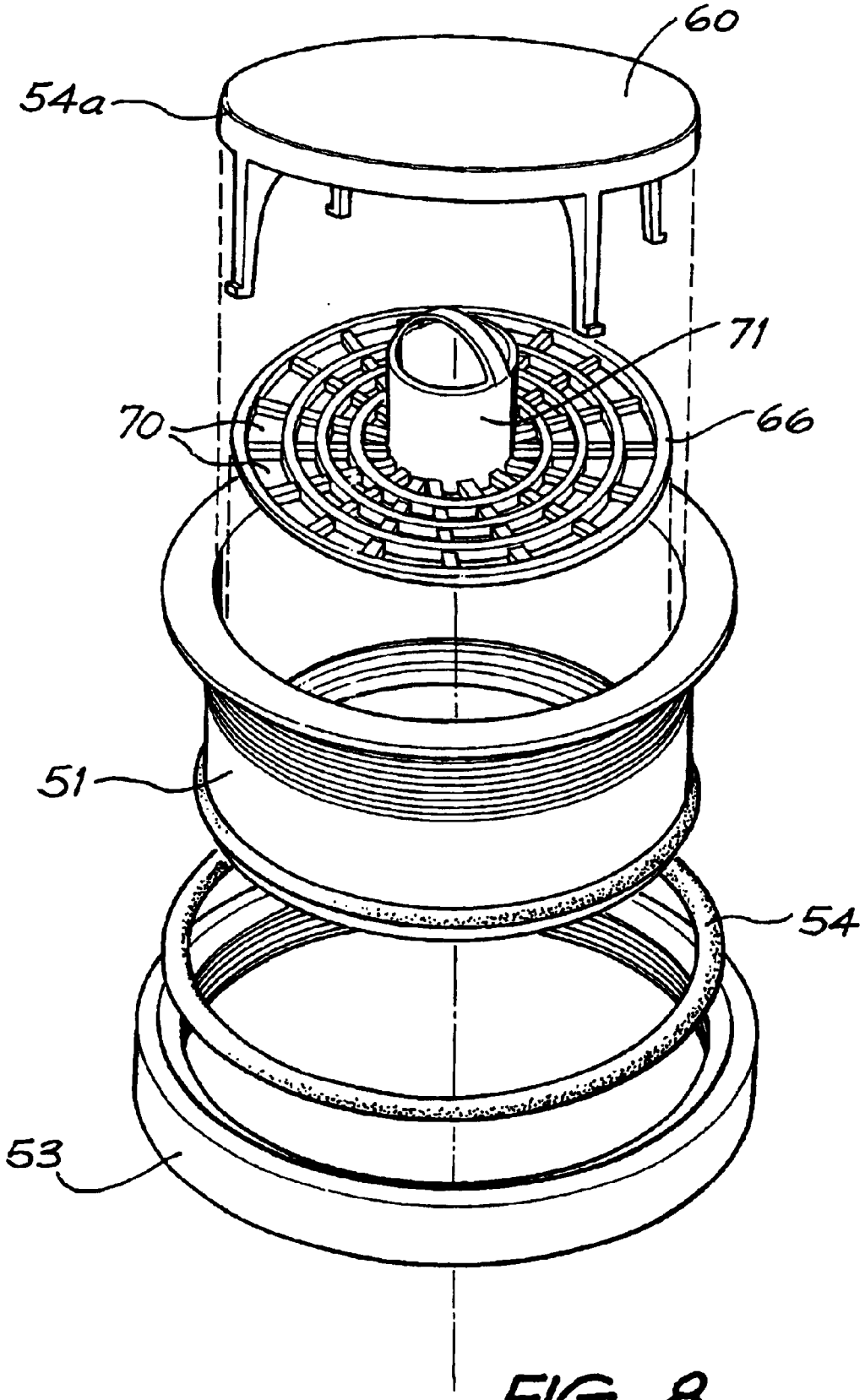
FIG. 8 shows an exploded view of the grate assembly of FIG. 7 with corresponding numbering.

Referring to FIG. 7 there is shown a grate assembly 50 according to a preferred embodiment providing an alternative to that shown FIG. 2.

Grate assembly 50 comprises peripheral retaining body 51 which engages an opening in a floor structure or floor member and is axially retained by flange 52. Preferably engagement between body 51 and said floor structure is facilitated by an external thread 51*a*. External thread 51*a* ideally assists with bonding to floor surface material such as cement, adhesives and the like to prevent unwanted dislodgememt. Preferably, a lock nut is screwed into thread 51*a* of retaining body 51. Body 51 is sealed against a locking nut 53 by O ring 54 to prevent ingress of floor waste between locking nut 53 and body 51.

Peripheral body 51 may be set into and flush with floor cladding such as tiles or may be fitted to a pre fabricated shower tray (not shown). There are two main alternatives for fitting peripheral body 51. The first involves use of a lock nut and O ring used preferably in shower tray installations. The second alternative body 51 is set in a tiled or cement surface. In this case thread 51*a* provides a roughened surface which keys into the cement thereby avoiding prior art bonding defects.

Peripheral body 51 may be injection molded or cast. As the peripheral body 51 is sealed by locking nut 53 this will prevent leakage of waste water between the floor or shower tray and the grate assembly.

Grate assembly 50 further comprises removeable cover 54 which locates in an opening 55 in peripheral body 51. Cover 54 further comprises flanges 56 and 57 which engages respective recesses 58 and 59 of peripheral body 51 to lock cover 54 into position. Upper surface 60 of cover 54 is cambered radially allowing a slight fall from the centre of upper surface 60 to peripheral region 63. Cover 54 further includes legs 61 and 62 each terminating in respective flanges 56 and 57. The attitude of legs 61 and 62 results in the formation of an annular recess 64 between legs 61 and 62 and peripheral body 51.

Radiused curve 65 facilitates passage of waste water into recess 64. Openings between legs 61 and 62 allow passage of waste water therebetween. Grate assembly 50 further comprises strainer plate 66 which seats on shoulder 67 of peripheral body 51.

Legs 61 and 62 seat on upper surface 73 of strainer plate 66. Strainer plate 66 further comprises openings 70 through which waste waterflows and an overflow tower 71 which includes handle 72 for easy removal. In use, waste water entering gap 64 eventual impacts on plate 66 and penetrates openings 70 In the event debris collects on plate 66 sufficient to block passage of waste water through openings 70 the waste water will be discharged via overflow tower 71 into a waste pipe which is part of plumbing infrastructure. Where this build up occurs, cover 54 may be removed by rotational displacement of the flanges 56 and 57 of legs 61 and 62 away from peripheral recess 58 whereupon debris on strainer plate 66 can be accessed and removed thereby clearing openings 70. Legs 61 and 62 as described result in four legs supporting cover 54. As an alternative multiple legs greater than or less than four may be used. As a further alternative a single pedestal support may be employed.

It will be recognised by persons skilled in the art that numerous variations and modifications may be made to the invention as broadly described herein without departing from the overall spirit and scope of the invention.

The claims defining the invention are as follows:

1. A ground surface waste assembly for receiving waste; the assembly including;

a waste collecting receptacle including an open mouth for receiving waste products from a flooring surface or appliance and a well which is defined by a floor and which receptacle has an outlet in fluid communication with said mouth, the outlet connecting the waste assembly to a waste drainage line for eventual discharge of said waste; said collecting receptacle also including a recessed beating surface extending at least partially about the periphery of said waste body and which is capable of supporting thereon an insert which forms part of a flooring; wherein, the insert forms a lid closing the receptacle so that the lid and receptacle when installed, are disposed below an upper flooring surface and wherein, the insert is capable of directly receiving and retaining a grate or appliance outlet; wherein the grate or appliance outlet may be positioned in an opening formed in the lid under a flooring surface level and at a height to accommodate a thickness of a floor cladding and at any location in the area of the insert and within the periphery of the collecting receptacle thereby allowing the assembly to accommodate a predetermined pattern, layout or configuration of flooring or ground cladding; wherein the assembly allows the grate or appliance outlet to be positioned in the insert not necessarily in alignment with under floor drainage plumbing; wherein the lid insert and receptacle are arranged so that when the grate or appliance outlet is disposed in the lid, surface water on the flooring can escape only via the inside of the receptacle.

2. A waste assembly according to claim 1 wherein said bearing surface is provided by a shoulder formed in the waste body; the bearing surface terminating in a peripheral wall defining a space in which said insert is placed.

3. A waste assembly according to claim 2 wherein said bearing surface includes projections which engage an underside surface of said insert thereby creating a gap between said shoulder and said insert to allow passage of waste therethrough.

4. A waste assembly according to claim 3 wherein said peripheral wall terminates in a peripheral flange; wherein an underside surface of the flange engages a support structure.

5. A waste assembly according to claim 4 wherein said outlet for connecting the collecting receptacle to said drainage waste line extends from a low point of said floor.

6. A waste assembly according to claim 5 wherein said outlet for connecting the receptacle to said drainage line extends from a side wall of said receptacle.

7. A waste assembly according to claim 1 wherein the mouth of said waste body is square or rectangular.

8. A waste assembly for receiving waste; the assembly including;

a waste collecting receptacle including an open mouth for receiving waste products from a flooring surface or appliance and a well which is defined by a floor and which receptacle has an outlet in fluid communication with said mouth, the outlet connecting the waste assembly to a waste drainage line for eventual discharge of said waste; said collecting receptacle also including a recessed bearing surface extending at least partially about the periphery of said waste body and which is capable of supporting thereon an insert which forms part of the flooring; wherein, the insert forms a lid closing the receptacle so that the lid and receptacle when installed, are disposed below an upper flooring surface and wherein, the insert is capable of receiving and retaining a grate or appliance outlet; wherein the grate or appliance outlet may be positioned in an opening formed in the lid under a flooring surface level and at a height to accommodate a thickness of a flooring cladding and at any location in the area of the insert and within the periphery of the collecting receptacle thereby allowing the assembly to accommodate a predetermined pattern, layout or configuration of flooring or ground cladding; wherein the assembly allows the grate or appliance outlet to be positioned in the insert not necessarily in alignment with under floor drainage plumbing; wherein the lid insert and receptacle are arranged so that when the grate or appliance outlet is disposed in the lid, surface water on the flooring can escape only via the inside of the receptacle, there being between said bearing surface and an underside surface of said insert, a gap to allow passage of waste therethrough.

9. A waste assembly according to claim 8 wherein said bearing surface includes projections which engage the underside surface of said insert thereby creating the gap.

10. A waste assembly according to claim 8 wherein said outlet for connecting the collecting receptacle to said drainage waste line extends from a low point of said floor.

11. A waste assembly according to claim 8 wherein said outlet for connecting the receptacle to said drainage line extends from a side wall of said receptacle.

12. A waste assembly according to claim 8 wherein the mouth of said waste body is square or rectangular.

* * * * *